US006273250B1

(12) United States Patent
Wu

(10) Patent No.: US 6,273,250 B1
(45) Date of Patent: Aug. 14, 2001

(54) GOLF BAG WITH A FOLDAWAY CHAIR

(76) Inventor: David Wu, No. 35-1, Jih-Hsin Street, Tu Cheng city, Taipei Hsien (TW)

( * ) Notice: Subject to any disclaimer, the term of this patent is extended or adjusted under 35 U.S.C. 154(b) by 0 days.

(21) Appl. No.: 09/583,888

(22) Filed: May 31, 2000

(51) Int. Cl.[7] ..... A63B 55/00; A63B 55/06

(52) U.S. Cl. ..... 206/315.3; 206/315.7; 297/188.01

(58) Field of Search ..... 206/315.3, 315.7, 206/315.8; 297/188.01

(56) References Cited

U.S. PATENT DOCUMENTS 2,438,078 * 3/1948 Sutphen ..... 206/315.3 X
2,736,357 * 2/1956 Stamp ..... 206/315.3
4,078,594 * 3/1978 Oeckl ..... 297/188.01 X
4,387,924 * 6/1983 Fernandez ..... 297/188.01

* cited by examiner

*Primary Examiner*—Sue A Weaver
(74) *Attorney, Agent, or Firm*—Varndell & Varndell, PLLC

(57) ABSTRACT

A golf bag having a foldaway chair coupled to a bottom cuff thereof, the foldaway chair having two mounting plates fixedly mounted on the bottom cuff at two opposite lateral sides, a first ⊓-shaped leg having two bottom ends respectively coupled to the mounting plates by a slip joint, and a second ⊓-shaped leg pivoted to the first ⊓-shaped leg by pivot means, and a flexible seat connected between the first ⊓-shaped leg and the second ⊓-shaped leg at a top side.

5 Claims, 4 Drawing Sheets

GOLF BAG WITH A FOLDAWAY CHAIR

BACKGROUND AND SUMMARY OF THE INVENTION

The present invention relates to a golf bag, and more particularly to such a golf bag, which is equipped with a foldaway chair.

When playing the game of golf, one may need to take a rest frequently. However, it is inconvenient to carry a chair with a golf bag in the golf course. It will be helpful to golf players to provide a golf bag with a folding collapsible chair.

According to one aspect of the present invention, the golf bag is equipped with a foldaway stand, and a foldaway chair. According to another aspect of the present invention, the foldaway chair comprises two mountign plates fixedly mounted on the bottom cuff of the bag body at two opposite lateral sides, a first ⊓-shaped leg having two bottom ends respectively coupled to the mounting plates by a slip joint, and a second ⊓-shaped leg pivoted to the first ⊓-shaped leg by pivot means, and a flexible seat connected between the first ⊓-shaped leg and the second ⊓-shaped leg at a top side.

DETAILED DESCRIPTION OF THE PREFERRED EMBODIMENT

Figure 1:
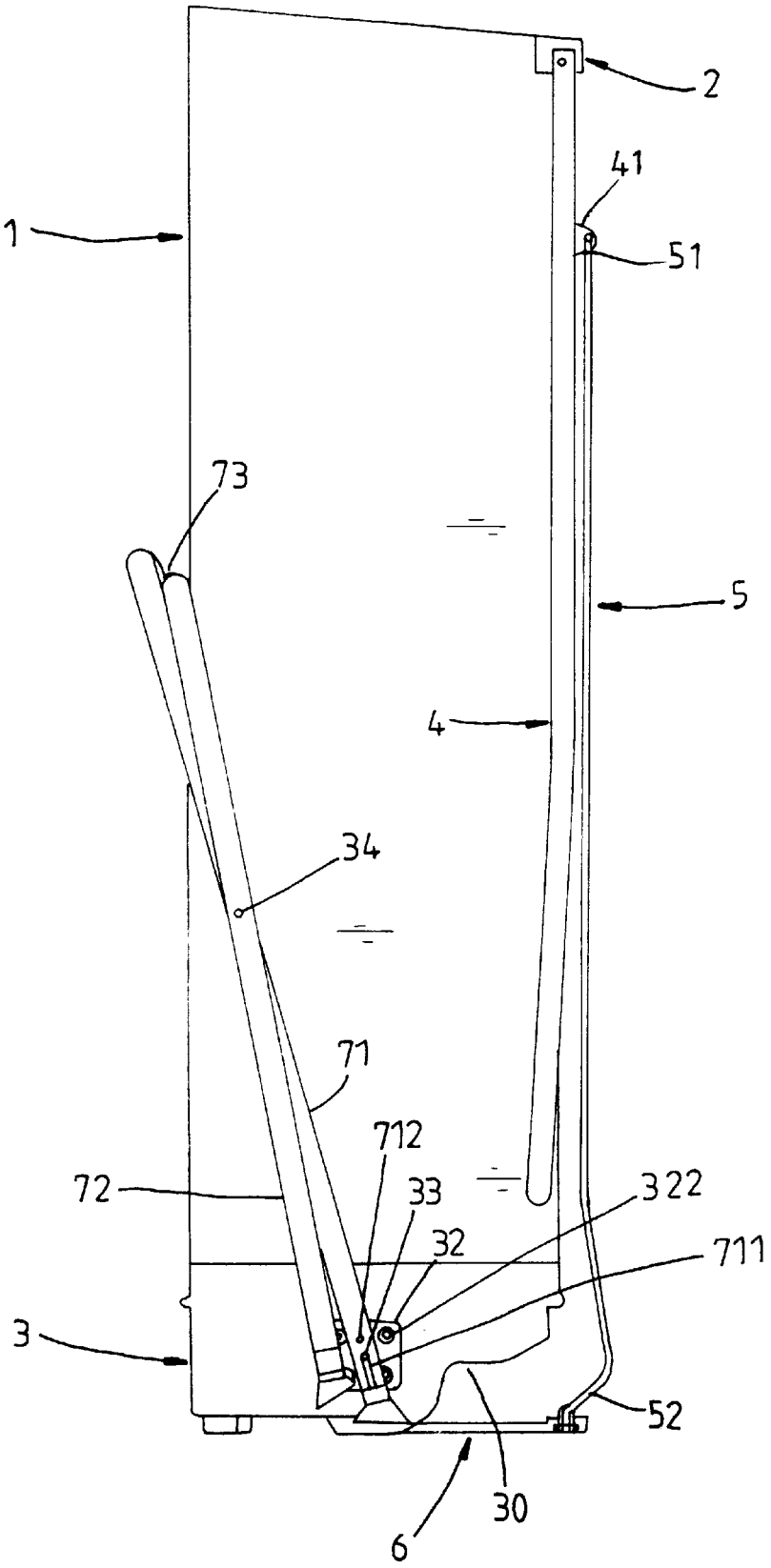
FIG. 1 is a side plain view of a golf bag according to the present invention, showing the foldaway stand and the foldaway chair collapsed.

Referring to FIGS. from 1 through 5, a golf bag in accordance with the present invention is generally comprised of a bag body 1, a foldaway stand, and a foldaway chair. The bag body 1 has a bottom recess 30 in the bottom side wall of the bottom cuff 3 thereof, and a top locating block 2 fixedly provided at the periphery of the top cuff thereof. The foldaway stand comprises two parallel legs 4 each having a top end pivoted to the locating block 2 and a lug 41 spaced from the top end at a distance, a bottom plate 6 having a fixed end pivoted to a fixed block (not shown) in the bottom recess 30 in the bottom side wall of the bottom cuff 3 and a free end 61, and two resilient support rods 5 each having a top end 51 pivoted to the lug 41 at one leg 4 and a bottom end 52 pivoted to the free end 61 of the bottom plate 6.

Figure 2:
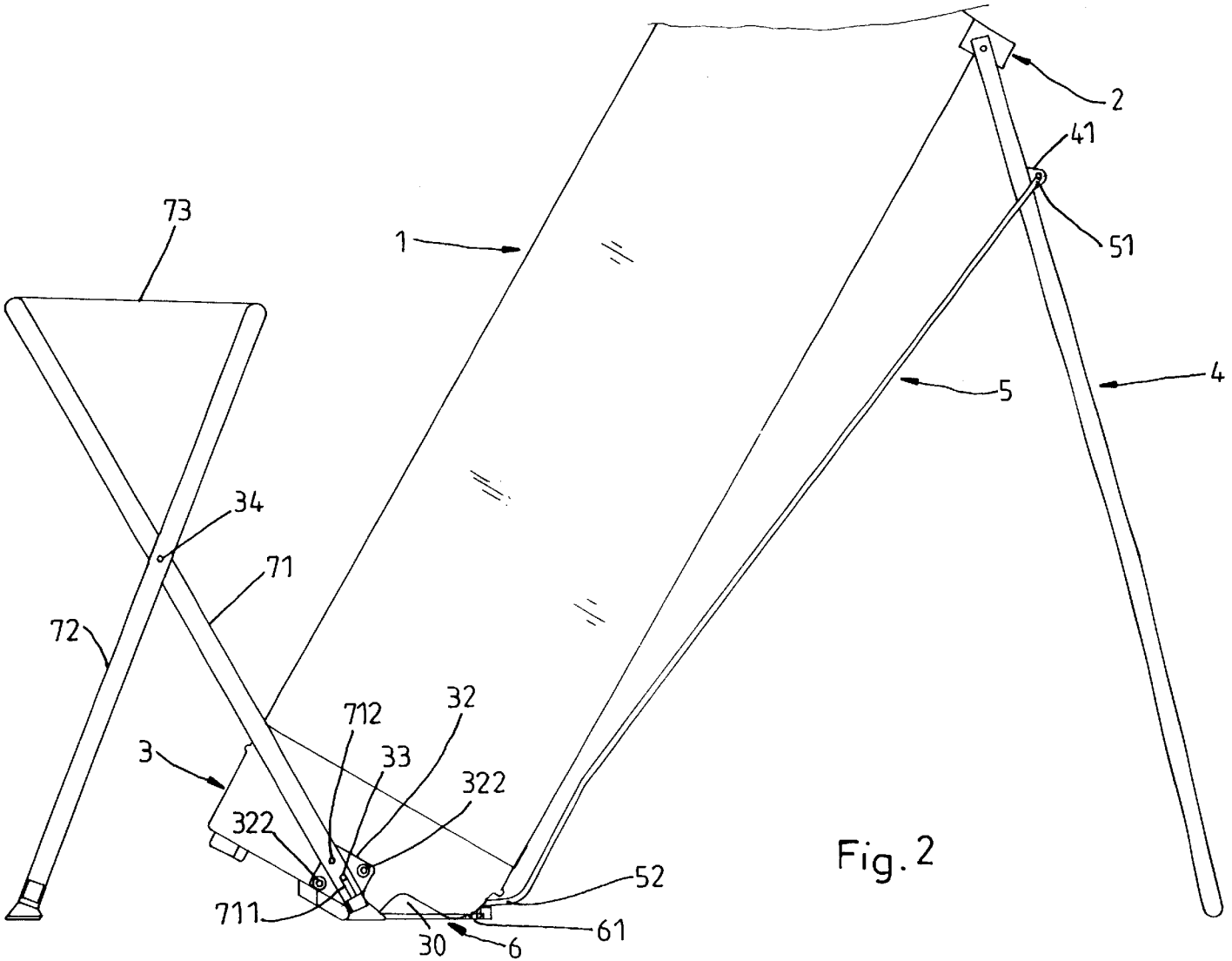
FIG. 2 is another side plain view of the present invention, showing the foldaway stand and the foldaway chair extended out.
Figure 3:
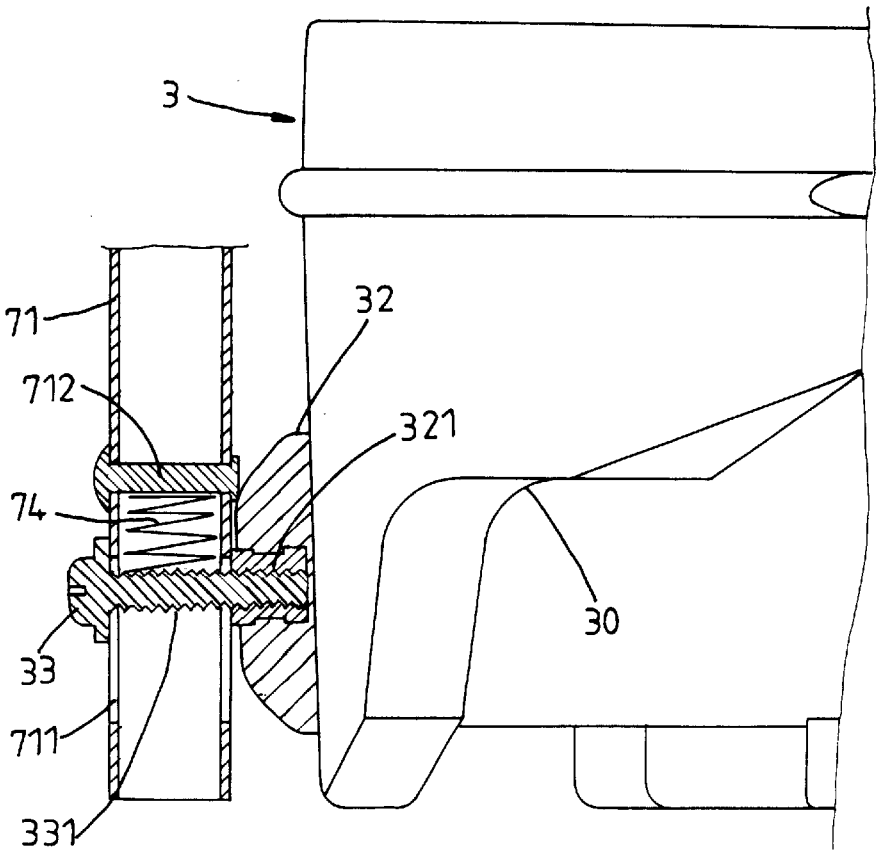
FIG. 3 is a sectional view in an enlarged scale of a part of the present invention, showing the connection between the first ⊓-shaped leg and the mountign plates.
Figure 4:
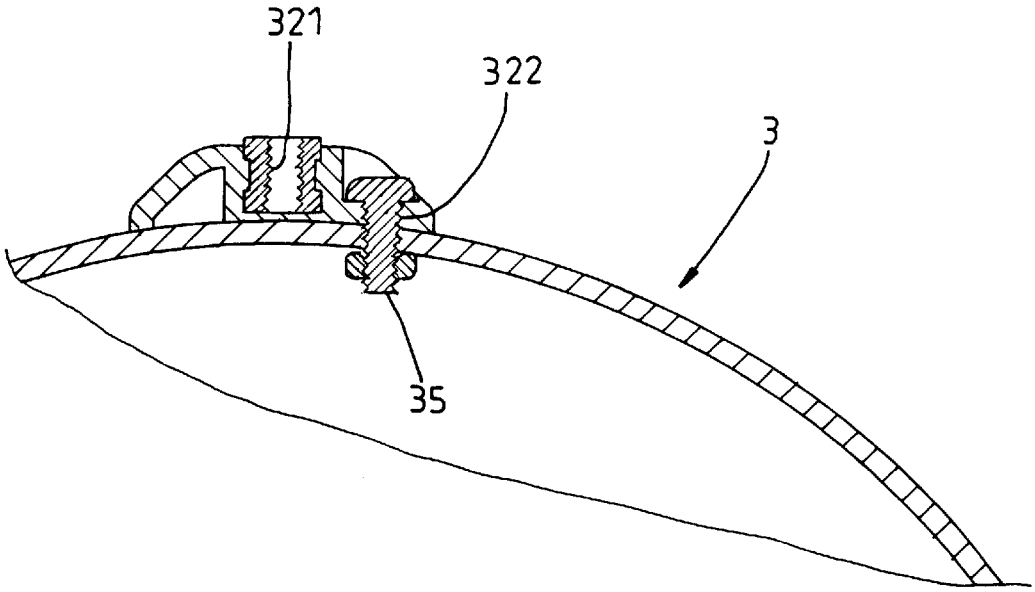
FIG. 4 is sectional view in an enlarged scale of a part of the present invention, showing the positioning of one mounting plate on the bottom cuff.
Figure 5:
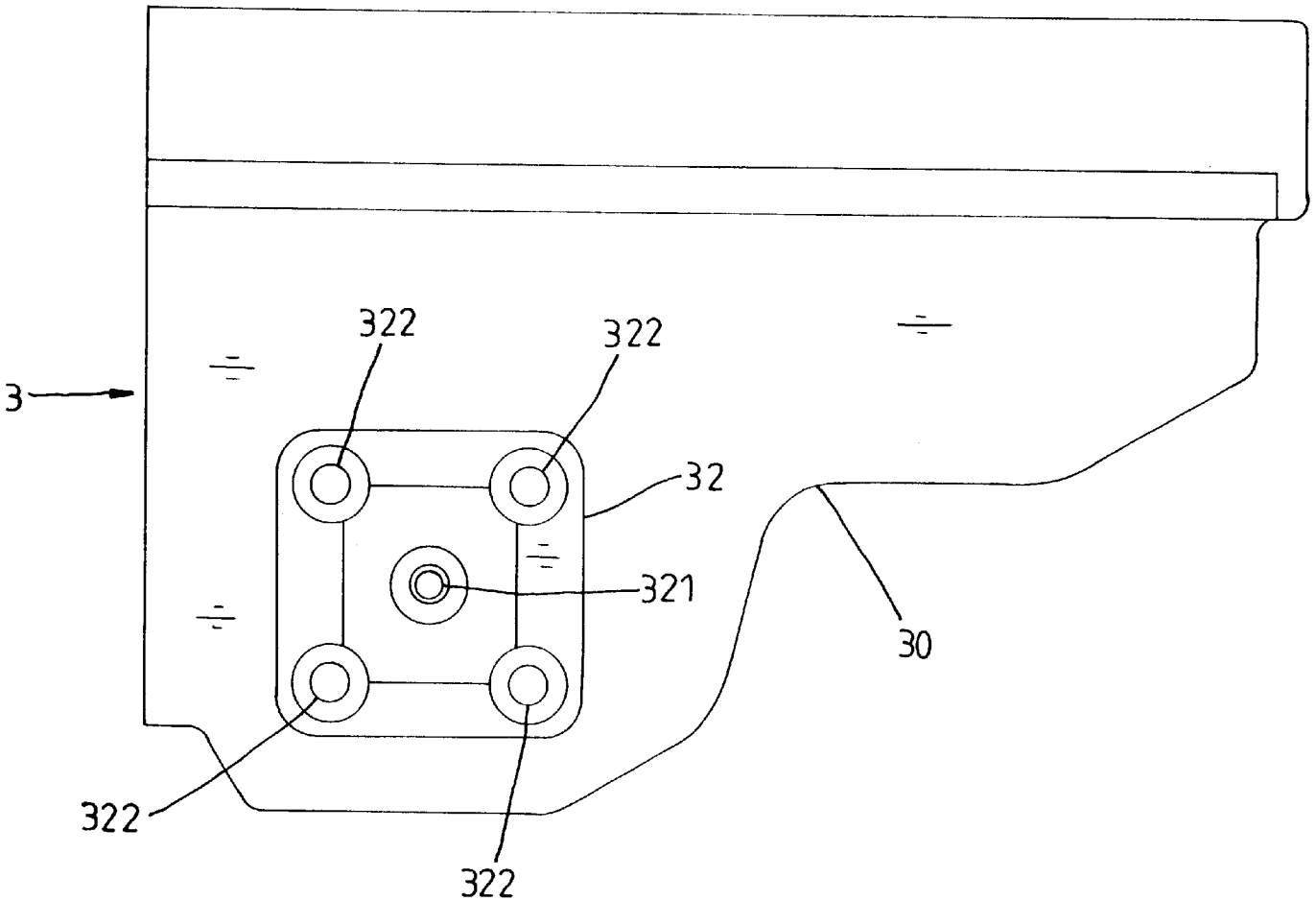
FIG. 5 is a front plain view of FIG. 4.

The aforesaid foldaway chair comprises two mounting plates 32 fixedly fastened to the bottom cuff 3 at two opposite lateral sides, a fist ⊓-shaped leg 71 and a second ⊓-shaped leg 72 pivoted to each other by pivots 34, and a flexible seat 73 connected between the first ⊓-shaped leg 71 and a second ⊓-shaped leg 72 at the top side. The mounting plates 32 each have a plurality of mounting holes 322, and a center screw hole 321. Fastening elements, for example, screws 35 are respectively installed in the mounting holes 322 to fixedly secure the mounting plates 32 to the bottom cuff 3. The first ⊓-shaped leg 71 has two elongated sliding slots 711 respectively disposed near the two bottom ends thereof. Two screw bolts 33 are respectively inserted through the elongated sliding slots 711 on the first ⊓-shaped leg 71 and threaded into the center screw hole 321 on each mounting plate 32 to secure the first ⊓-shaped leg 71 to the mounting plates 32, enabling the first ⊓-shaped leg 71 to be turned about the threaded shank 331 of the screw bolts 33 between a first position where the foldaway chair is folded up and closely attached to the bag body 1 (see FIG. 1), and a second position where the foldaway chair is extended out (see FIG. 2). The first ⊓-shaped leg 71 further comprises two transverse locating rods 712 respectively provided near the two bottom ends above the elongated sliding slots 711, and two springs 74 respectively installed in the two bottom ends and connected between the transverse locating rods 712 and the screw bolts 33. The springs 74 impart an upward pressure to the first ⊓-shaped leg 71, preventing the bottom ends of the first ⊓-shaped leg 71 from touching the ground after the first ⊓-shaped leg 71 was moved from the second position to the first position. Further, the flexible seat 73 can be a cloth seat, for exmaple, a canvass seat.

As indicated above, the golf bag has a foldaway stand that can be extended out to support the golf bag in a tilted position on the ground, and a foldaway chair that can be extended out for sitting when the foldaway stand supports the golf bag in the tilted position.

What is claimed is:

1. A golf bag comprising a foldaway chair coupled to a bottom cuff thereof, said foldaway chair comprisng two mounting plates fixedly mounted on said bottom cuff at two opposite lateral sides, a first ⊓-shaped leg having two bottom ends respectively coupled to said mounting plates by a slip joint, and a second ⊓-shaped leg pivoted to said first ⊓-shaped leg by pivot means, and a flexible seat connected between said first ⊓-shaped leg and said second ⊓-shaped leg at a top side.

2. The golf bag of claim 1 wherein said slip joint comprises two elongated sliding slots respectively formed in the two bottom ends of said first ⊓-shaped leg, two pivot bolts respectively inserted through said elongated sliding slots and installed in said mounting plates, and two transverse locating rods respectively provided at the bottom ends of said ⊓-shaped leg above said elongated sliding slots, and two springs respectively connected between said transverse locating rods and said screw bolts to impart an upward pressure to said first ⊓-shaped leg.

3. The golf bag of claim 2 wherein said mounting plates each have a center screw hole, and said pivot bolts are threaded bolts respectively threaded into the center screw hole on each of said mounting plates.

4. The golf bag of claim 1 wherein said mounting plates each have a plurality of mounting holes respectively fastened to said bottom cuff by fastening elements.

5. The golf bag of claim 1 wherein said flexible seat is a cloth seat.

* * * * *